United States Patent [19]

Prunbauer

[11] 4,294,091

[45] Oct. 13, 1981

[54] CONTROL DEVICE FOR CYLINDER LOCKS

[75] Inventor: Kurt Prunbauer, Herzogenburg, Austria

[73] Assignee: Evva Werk Spezialerzeugung von Zylinder- und Sicherheitsschlossern Gesellschaft m.b.H. & Co. Kommanditgesellschaft, Vienna, Austria

[21] Appl. No.: 12,895

[22] Filed: Feb. 16, 1979

[30] Foreign Application Priority Data

Feb. 20, 1978 [AT] Austria ..... 1222/78

[51] Int. Cl.[3] ..... E05B 9/04; E05B 47/00

[52] U.S. Cl. ..... 70/276; 70/360; 70/376

[58] Field of Search ..... 70/276, 386, 365, 356, 70/358, 360, 421, 376, DIG. 75

[56] References Cited

U.S. PATENT DOCUMENTS

| | | | |
|---|---|---|---|
| 347,445 | 8/1886 | Sherman | 70/421 X |
| 1,135,027 | 4/1915 | Kohlberger | 70/DIG. 75 |
| 1,444,429 | 2/1923 | Rogginger | 70/360 X |
| 1,513,718 | 10/1924 | Morehouse | 70/360 X |
| 1,869,426 | 8/1932 | Jacobi | 70/360 |
| 1,969,012 | 8/1934 | Jacobi | 70/360 |
| 2,460,615 | 2/1949 | Andrew | 70/386 X |
| 3,654,782 | 4/1972 | Heimann | 70/276 |
| 3,968,668 | 7/1976 | Epstein | 70/386 X |
| 4,228,667 | 10/1980 | Herriott | 70/276 |

FOREIGN PATENT DOCUMENTS

| | | | |
|---|---|---|---|
| 2349760 | 4/1975 | Fed. Rep. of Germany | 70/276 |
| 2614645 | 6/1977 | Fed. Rep. of Germany | 70/360 |
| 504473 | 7/1920 | France | 70/421 |
| 1104121 | 11/1955 | France | 70/358 |
| 1359748 | 3/1964 | France | 70/276 |
| 435509 | 5/1948 | Italy | 70/360 |

*Primary Examiner*—Roy D. Frazier
*Assistant Examiner*—Carl F. Pietruszka
*Attorney, Agent, or Firm*—Michael J. Striker

[57] ABSTRACT

A control device for a magnetic cylindrical lock having a cylindrical housing and a cylindrical plug disposed for rotational and axial movements in the housing, comprises a longitudinal boring in the plug, magnetic rotary members arranged for rotation across the longitudinal boring, and arresting means for blocking the rotation of the plug in one axial position of the latter and for permitting the rotary movement in another axial position.

5 Claims, 7 Drawing Figures

CONTROL DEVICE FOR CYLINDER LOCKS

BACKGROUND OF THE INVENTION

This invention relates generally to an arresting control device and more particularly it relates to a control device for a magnetic cylinder lock having a stationary cylindrical housing and a rotatable plug arranged in the housing.

SUMMARY OF THE INVENTION

The primary object of this invention is to provide an improved control device which permits the actuation of the plug in a lock with a magnetically coded key, whereby the decoding of the lock is rendered more difficult.

In keeping with this object, and others which will become apparent hereafter, one feature of the invention resides in the provision of a cylindrical plug which, in addition to rotational movement is also axially displaceable between two axial positions in the housing whereby arresting means disposed between the plug and the housing are operable for blocking the rotary movement of the plug in one of the axial positions and for unblocking in this rotary movement in another axial position.

Preferably, the cylindrical plug cooperates with a cylindrical sleeve which is interposed between the plug and the housing and is provided with an axial groove which engages with a radial extension of the cylindrical plug so that in the unblocking position the sleeve rotates together with the plug. In the blocking position, the extension is guided in an axial groove in the housing so that the rotation of the sleeve and of the plug itself is prevented.

The plug has a central key channel and longitudinal borings extending parallel with the central channel and communicating with transverse or radial blind bores. In each blind bore, a magnetic rotary member or rotor is supported for rotation about an axis which extends perpendicularly to the key channel. The magnetic rotary members intersect the longitudinal boring and are provided with diametrical borings which, in a particular angular position of the rotary member are coaxial with the center axis of the longitudinal boring. A plurality of discrete arresting elements are arranged in the longitudinal boring between respective rotary members and also in the diametrical borings of the latter. In the aligned position of the diametrical borings with the longitudinal boring, the arresting elements contact each other and abut against terminal walls of the housing or of the rotary sleeve. The cylindrical plug is axially biased by spring means, for example, into an inoperative position in which at least one rotary member is misaligned with the longitudinal boring and the arresting elements of the control device prevent the angular displacement of the plug. If, by the insertion of a properly coded key, the rotary members are turned in such a manner as to have their diametrical borings in alignment with the longitudinal boring, the plug can be axially displaced into an operative position in which it is permitted to rotate about its axis thus activating a locking bolt.

In a modification of this invention, instead of slidable arresting elements there are provided longitudinal arresting means guided in axial grooves on the upper surface of the cylindrical plug and being rotatable therewith. A plurality of arresting bolts project in radial direction from the arresting beams into the lateral passage and cooperate with matching recesses in the magnetic rotary members to block in one axial position of the plug the rotation of the latter and in another axial position to unblock this rotation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
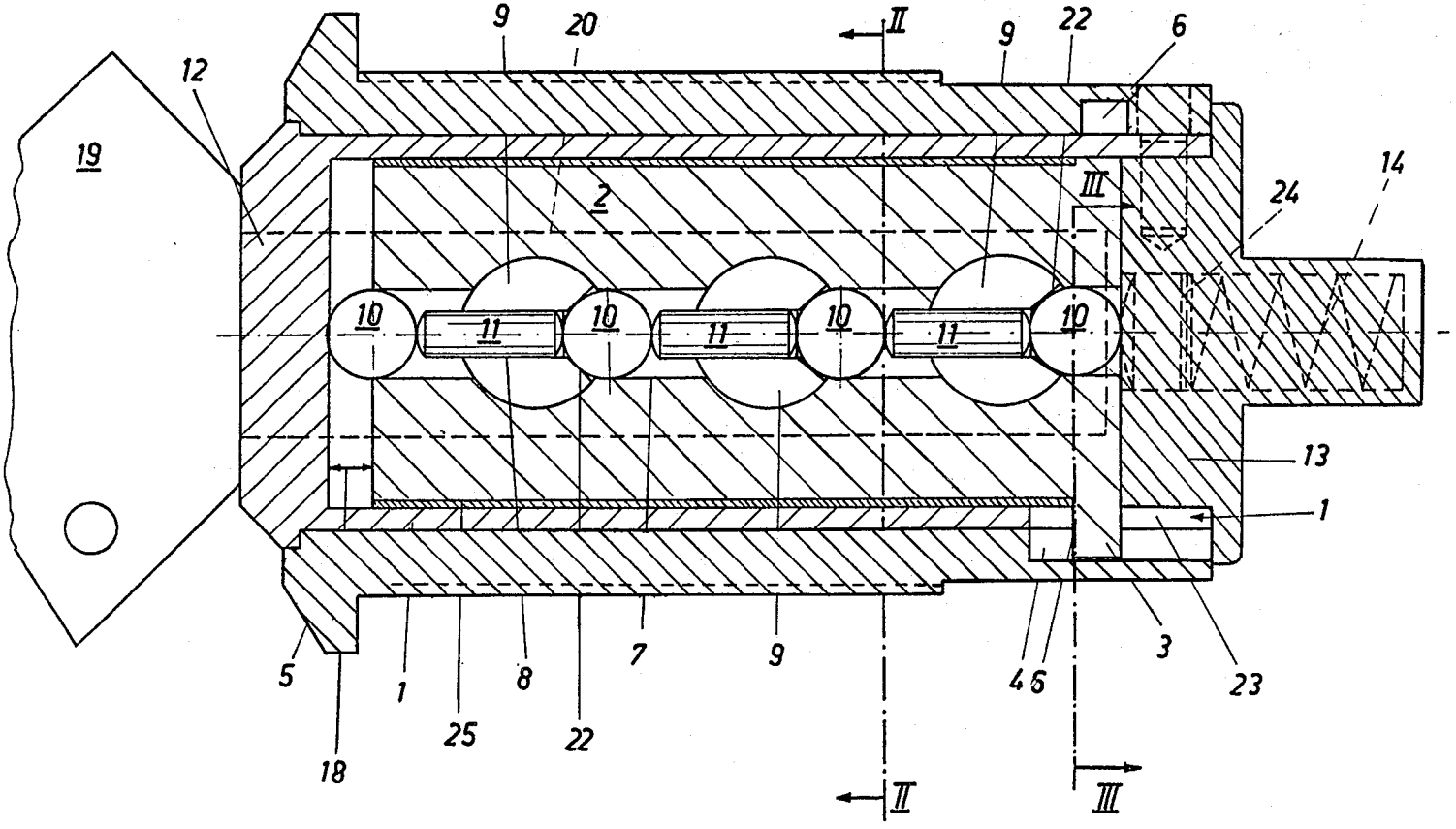
FIG. 1 is a sectional side view of a magnetically controllable cylindrical lock including the control device of this invention, taken along the line I—I of FIG. 2.

The control device of this invention includes a stationary housing 5 defining a cylindrical passage in which a cylindrical sleeve 1 is rotatably supported. Each end of sleeve 1 is closed by a terminal plate 12 and 13 and in the cylindrical space inside the sleeve 1, a cylindrical plug 2 is arranged for rotation about its center axis and for axial displacement about a distance indicated by double arrow 18. Plug 2 defines a central key channel 20 into which a magnetically coded key 19 is insertable from the left side. At each side of central key channel 20 a longitudinal boring 7 extends parallel to the latter and communicates with radial blind borings 21 (FIG. 2) in which magnetic rotors or rotary members 9 are supported for rotation. The axis of rotation of each rotary member 9 coincides with the center axis of the assigned blind boring 21. Each rotary member 9 has a diametrical boring 8 which in one angular position of the rotary member is aligned with the longitudinal boring 7. In this embodiment the longitudinal boring 7 has a larger diameter than the diametrical boring. One end of diametrical boring 8 is conically extended to form a funnel-shaped portion 22 opening into the longitudinal boring 7. Cylindrical arresting elements 11 having a length corresponding to the diameter of rotary members 9 are slidably arranged in respective diametrical borings and cooperate with spherical arresting elements 10 arranged in the longitudinal boring 7 between respective rotary members 9. As is apparent from FIG. 1, the dimensions of respective arresting elements 10 and 11 are such that cylindrical pins 11 can freely project from their diametrical borings 8 into the adjoining sections of longitudinal boring 7 but the arresting balls 10 can enter only the funnel-shaped portion 22 of the rotary members 9.

Figure 2:
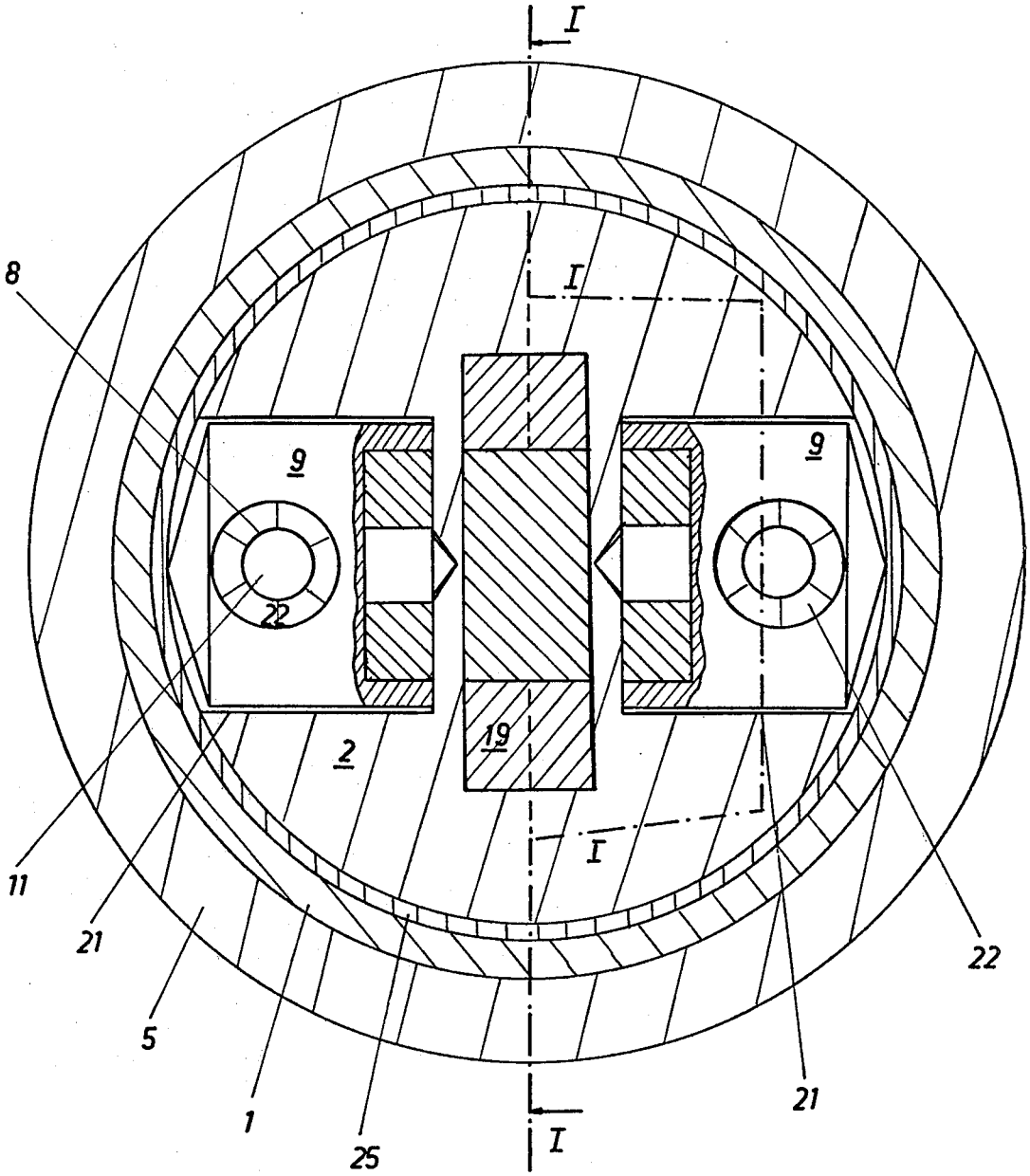
FIG. 2 is sectional rear view of the lock of FIG. 1 taken along the line II—II.
Figure 3:
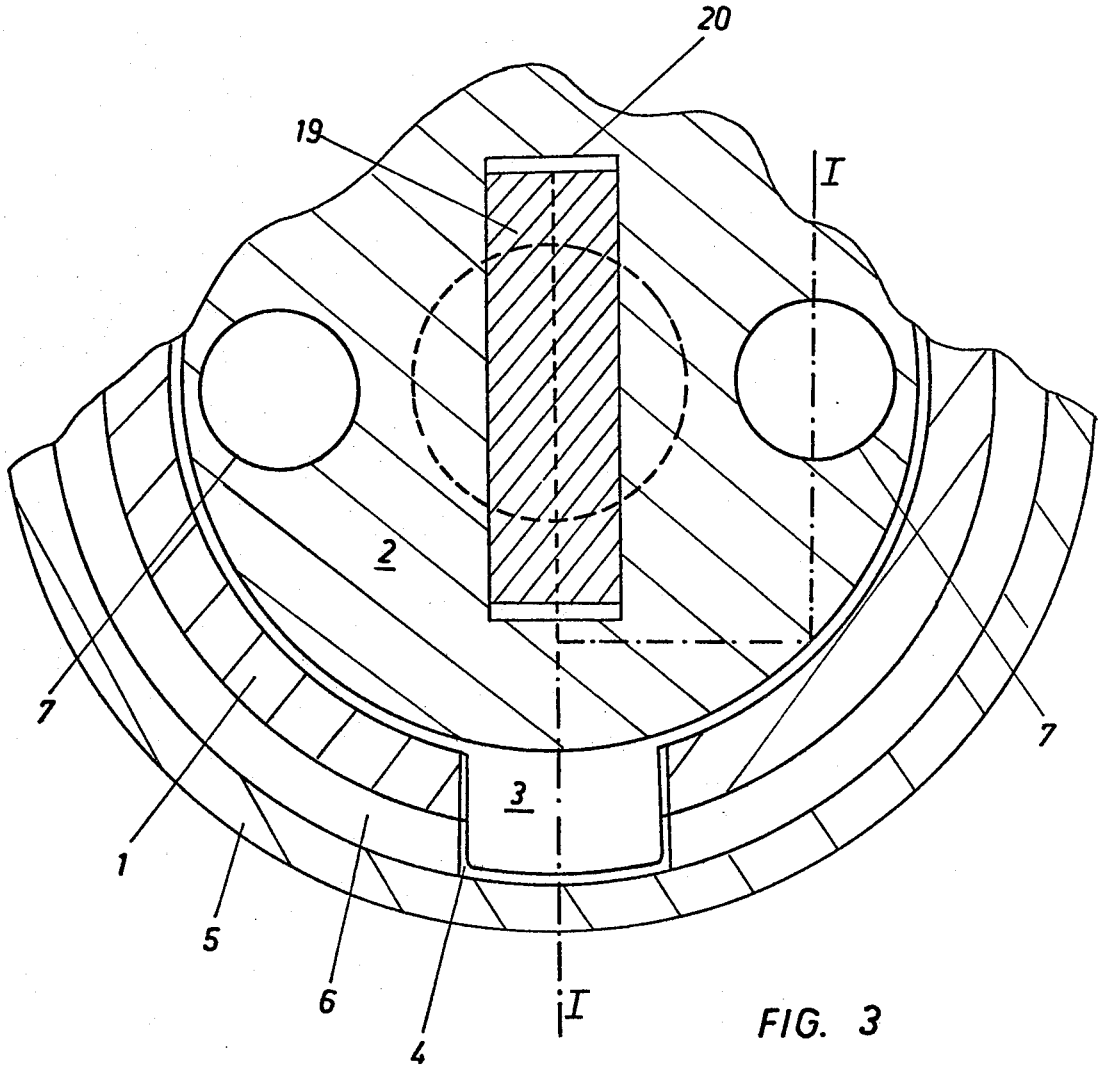
FIG. 3 is a sectional front view of a cut-away portion of the lock of FIG. 1 taken along the line III—III.

The end of plug 2 facing the rear cover plate 13 is provided with a radial extension 3 which projects through a recess 23 in sleeve 1 into an axially directed groove 4 in the inner wall of housing 5. This axial groove 4 communicates with an annular groove 6 provided in the inner wall portion of housing 5 for guiding the extension 3 so that this extension together with plug 2 and sleeve 1 can be rotated by key 19 about a common center axis. This rotary movement, however, is possible only in the position of plug 2 in which the diametrical borings 8 of rotary members 9 are aligned with longitudinal boring 7 and plug 2 is axially displaced to the right as illustrated in FIG. 1. If plug 2 is shifted to the left, the extension 3 is out of alignment with annular groove 6 and axial groove 4 prevents the rotation of the plug.

A pressure spring 14 arranged in a central opening of terminal plate 13 urges a spring pin 24 against the center of the base of plug 2 and pushes the latter to the left. To facilitate the movement of plug 2 in sleeve 1, a jacket 25 is interposed between the plug and the sleeve. The jacket reduces friction between the plug and the sleeve and also supports pivot points of rotary members 9.

Figure 4:
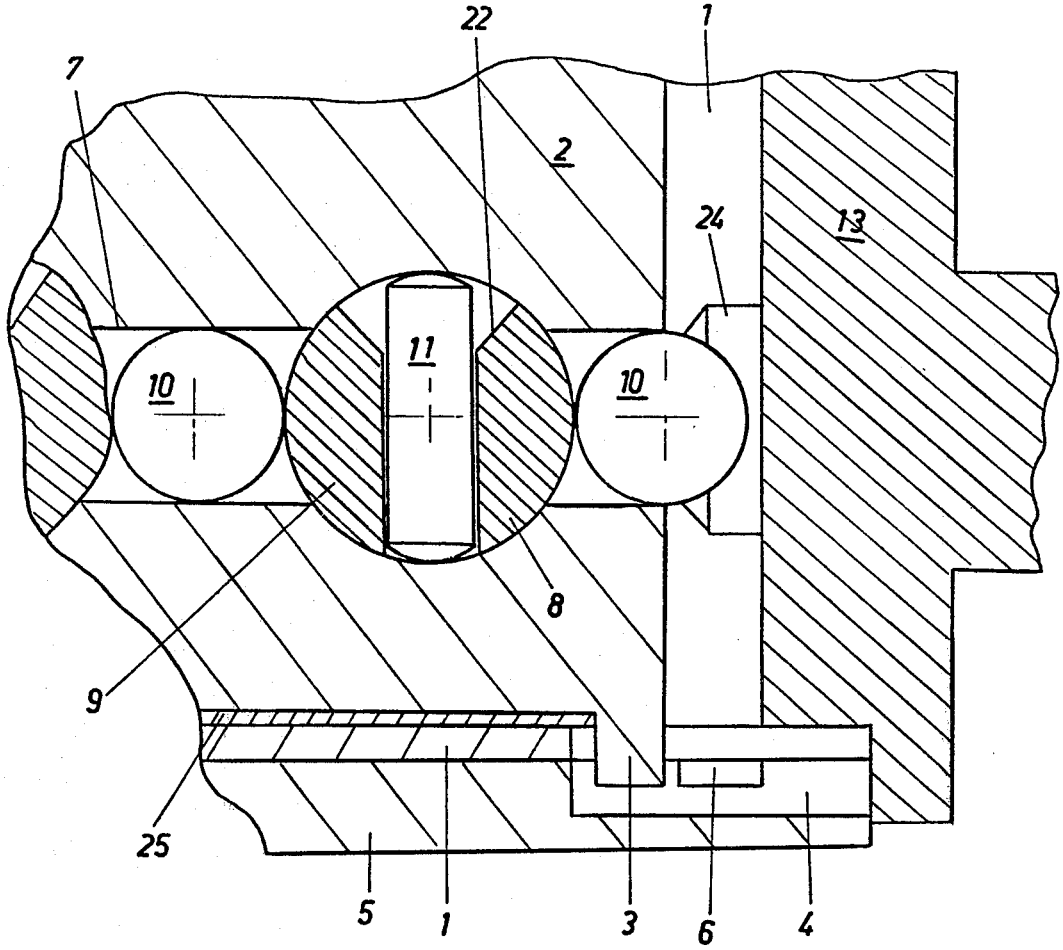
FIG. 4 is a sectional side view of a cut-away portion of the lock of FIG. 1 showing another axial position of the control device.

In the inoperative or arresting position of plug 2 in which no key is inserted into the key channel, spring 14 axially displaces plug 2 to the left so that the latter abuts against the front cover plate 12. In this arresting position, radial extension 3 is situated at the left end of axial groove 4 past the annular groove 6. As has been mentioned above, in this left hand position the key 19 cannot rotate the plug 2 and sleeve 1. If a wrong key 19 is inserted into key channel 20, magnetic rotary members 9 have different angular positions in which the diametrical borings 8 are misaligned with longitudinal boring 7 (FIG. 4) and consequently plug 2 cannot be shifted relative to arresting balls 10. If an incorrectly coded key is inserted and an axial pressure is exerted against plug 2, this axial pressure is intercepted by the balls 10 and rotary members 9 and plug 2 cannot be axially displaced to the right to resume its operative position.

If, however, a correctly coded key is used, so the magnetic rotary members are rotated into their aligned position as illustrated in FIG. 1 and by exerting axial pressure by the key 19, the plug is displaced to the right whereby balls 10 partially enter the funnel-shaped portion 22 of diametrical borings of magnetic rotary members 9.

By virtue of the arrangement of funnels 22 at one end of diametrical borings 8 only, the full arresting action of bolts 10 is ensured even if rotors 9 are turned, through 180°.

Figure 5:
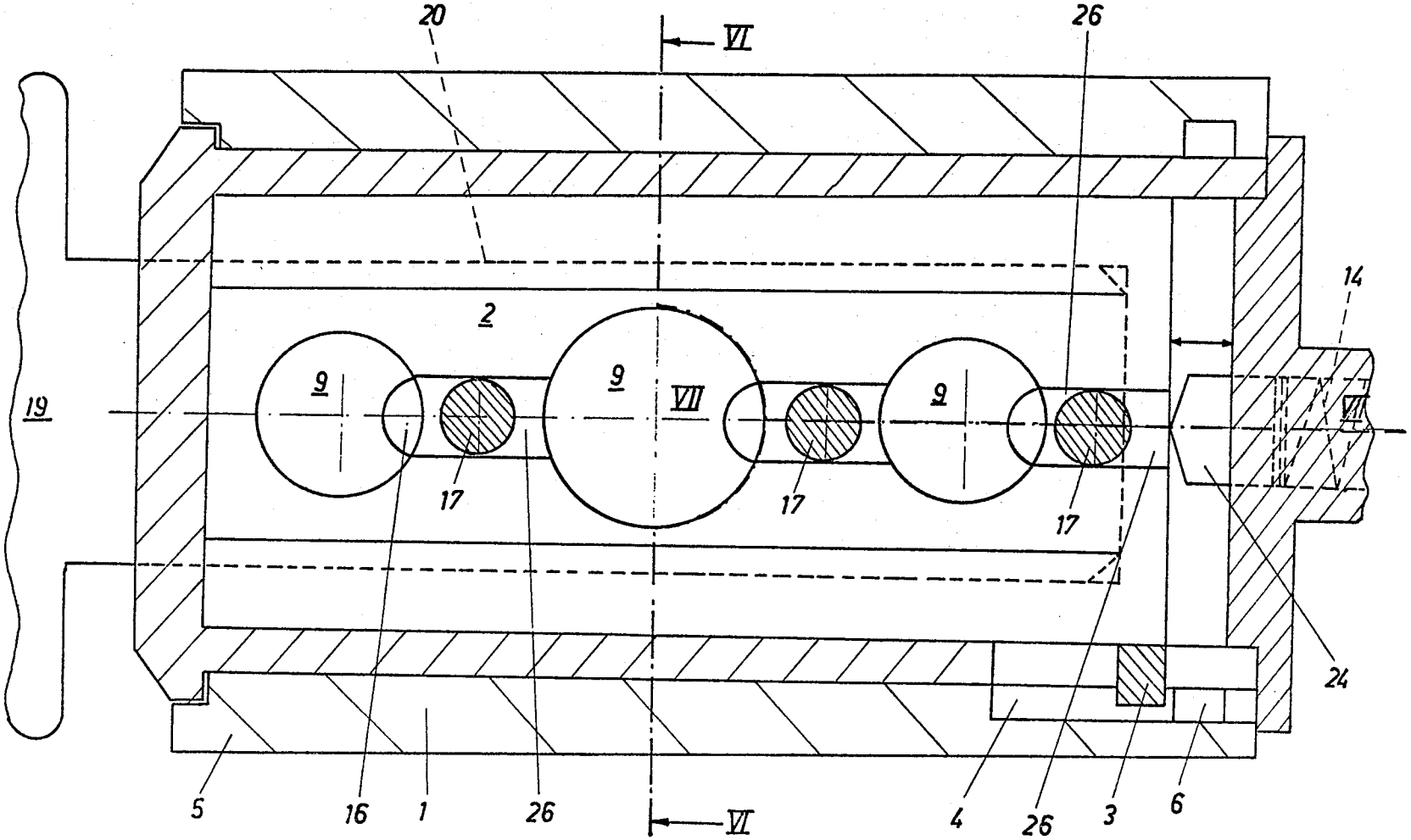
FIG. 5 is a sectional side view taken along the line V—V of FIG. 6 showing another embodiment of the device of this invention.
Figure 6:
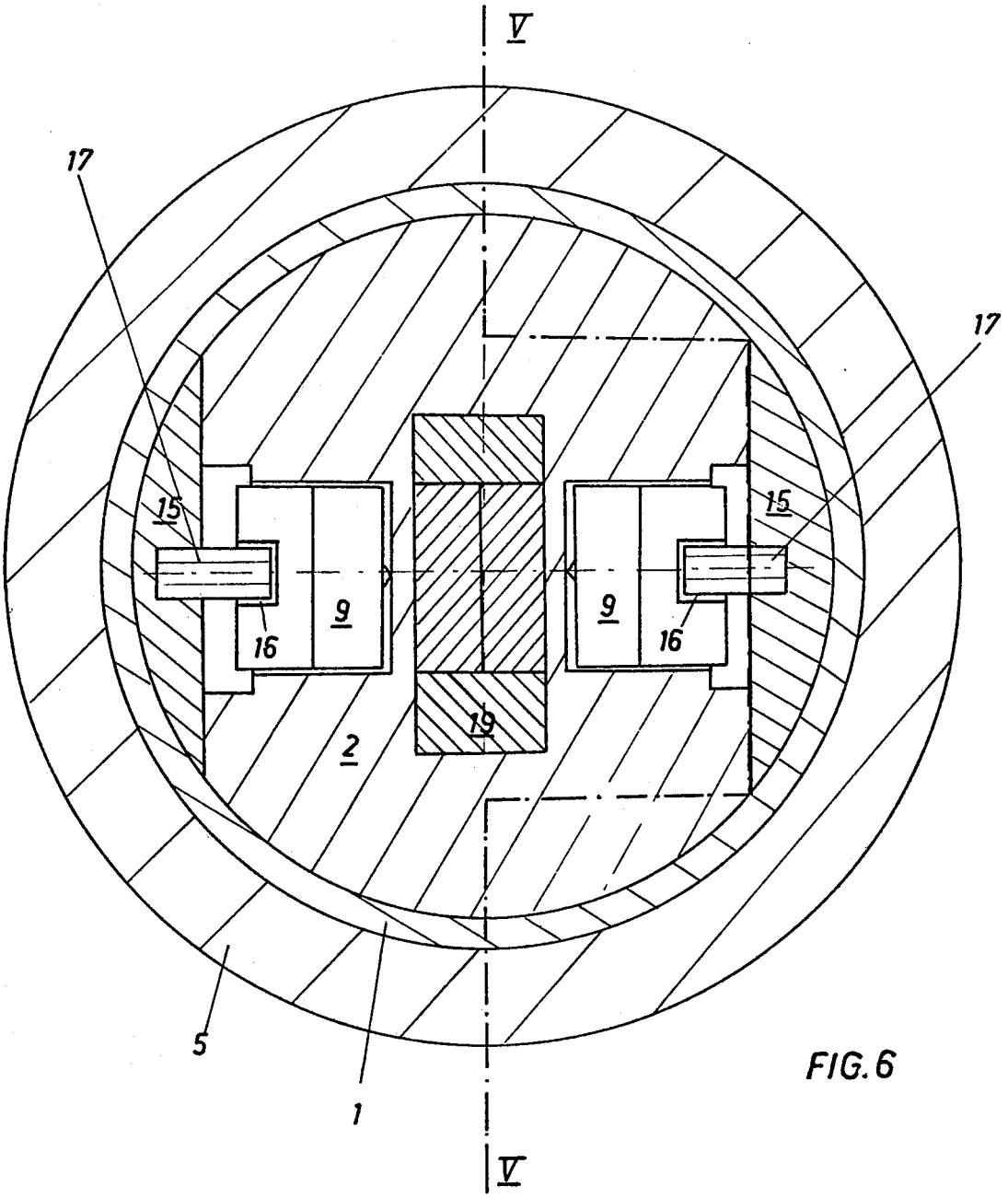
FIG. 6 is a sectional rear view taken along the line VI—VI of FIG. 5.
Figure 7:
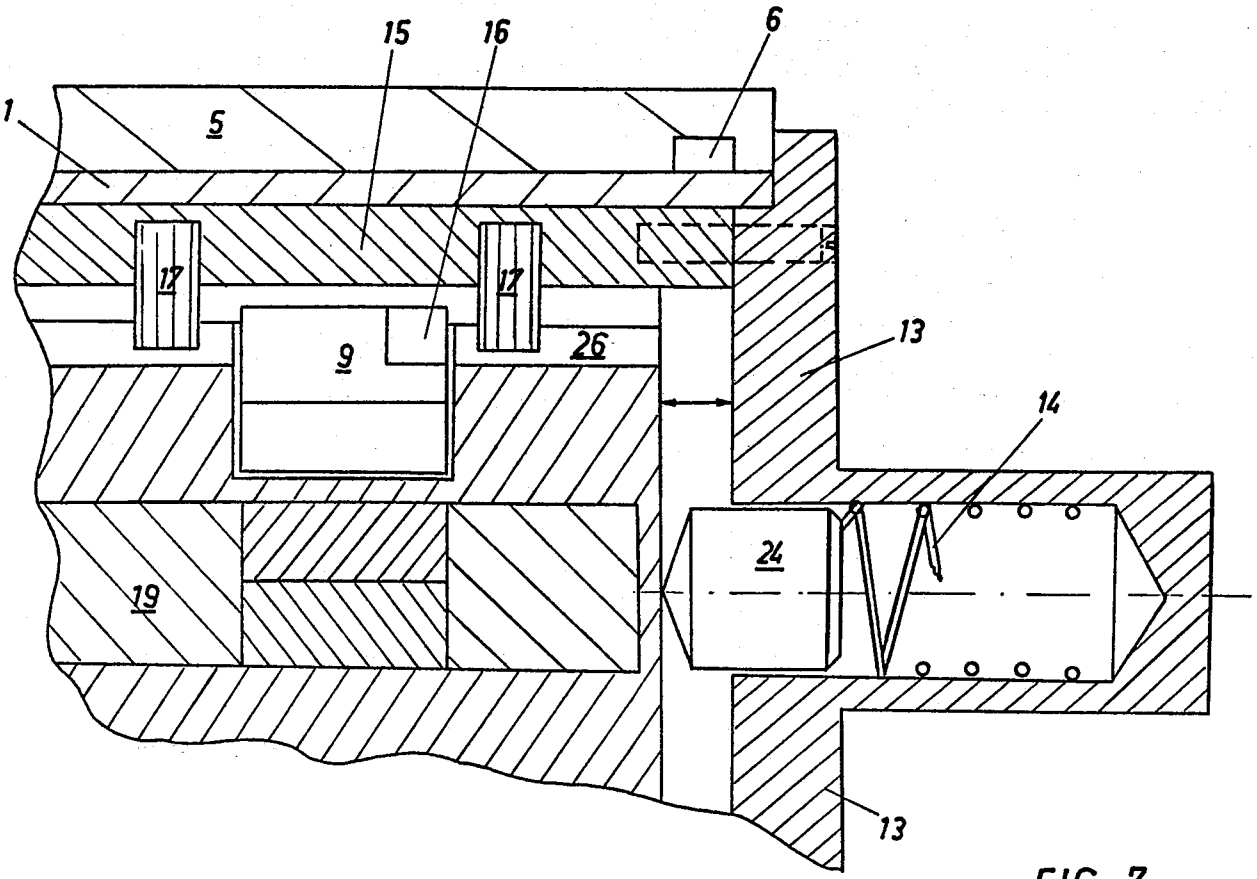
FIG. 7 is a sectional side view of a cut-away portion of the device of FIG. 5, taken along the line VII—VII.

A modification of this invention is illustrated in FIGS. 5 through 7. Instead of discrete arresting elements 10 and 11 this embodiment employs arresting beams 15 which are provided with arresting pins 17 projecting into the longitudinal passages 7. Arresting beams 15 extend in axial direction along the cylindrical upper surface of plug 2 and are fixedly connected to the rear cover plate 13. Consequently, the arresting beams 15 are not axially displaceable but they can be rotated by key 19 together with end plate 13 and sleeve 1. Plug 2 is provided with grooves 26 in which the arresting pins 17 are guided so that plug 2 is axially displaceable relative to the arresting pins. The cylindrical walls of magnetic rotary members 9 are provided with recesses 16 matching the arresting pins 17 so that the latter in a correctly aligned position of the rotary members can engage these recesses and the locking process in this operative position of plug 2 can take place in the same manner as described above in connection with FIG. 1. In other words, by pressing a right key 19 against the front base of plug 2 counter to the pressure of spring 14, the plug is axially shifted to the right so that extension 3 is in alignment with annular groove 6 and plug 2 can be rotated about its axis.

It will be understood that each of the elements described above, or two or more together, may also find a useful application in other types of constructions differing from the types described above.

While the invention has been illustrated in the specific examples of a cylindrical lock, it is not intended to be limited to the details shown, since various modifications and structural changes may be made without departing in any way from the spirit of the present invention. For example, several axial grooves 4 can be provided in the inner wall of housing 5 so as to enable an arresting rotation through 180° or 270°. Also, the annular groove 6 and the corresponding extension 3 can be arranged at different locations between the plug 2 and housing 5. It is possible to employ other rotation blocking means instead of the extension 3 such as for example, spring biased arresting bolts which are axially displaceable relative to the plug, or the plug can be also provided with displaceable plug portions.

What is claimed as new and desired to be protected by Letters Patent is set forth in the appended claims:

1. A control device, particularly for use in a magnetic cylinder lock, comprising, a housing defining a cylindrical passage, a cylindrical plug disposed in said passage for a rotational and axial movement relative to said housing; arresting means operable between said plug and said housing for blocking the rotational movement in one axial position of said plug and for unblocking the rotational movement in another axial position thereof; said plug having a radial extension and said housing defining an axial groove in engagement with said extension and an annular groove communicating with said axial groove to guide said extension in said other axial position; said plug including at least one longitudinal boring, a plurality of rotary members arranged respectively for rotation about an axis transverse to said longitudinal boring and each defining a diametrical boring which at one angular position of the rotary member is in alignment with said longitudinal boring, a plurality of arresting elements arranged in said longitudinal and diametrical borings over the entire length of said passage in the housing, and biasing means normally urging said plug into said one axial position.

2. The device as defined in claim 1, wherein the diameter of said longitudinal boring is larger than the diameter of said diametrical boring, said arresting elements being balls arranged between respective rotary members and having a diameter corresponding to the diameter of said longitudinal boring, and pins corresponding in length and in diameter to the assigned diametrical borings.

3. The device as defined in claim 1, wherein each diametrical boring has at one end thereof a funnel-like portion adapted for partially receiving said arresting ball from said longitudinal boring.

4. The device as defined in claim 1; further including a sleeve rotatably arranged between said plug and said housing, and terminal cover plates for closing the ends of said passage in said housing.

5. The device as defined in claim 4, wherein a biasing spring is arranged in one of said cover plates to urge said plug against the other cover plate.

* * * * *